US009133845B2

(12) United States Patent
Kim et al.

(10) Patent No.: US 9,133,845 B2
(45) Date of Patent: Sep. 15, 2015

(54) SCROLL COMPRESSOR HAVING A BACK PRESSURE ADJUSTMENT DEVICE

(75) Inventors: Yang Sun Kim, Suwon-si (KR); Sung Hea Cho, Yongin-si (KR)

(73) Assignee: SAMSUNG ELECTRONICS CO., LTD., Suwon-Si (KR)

( * ) Notice: Subject to any disclaimer, the term of this patent is extended or adjusted under 35 U.S.C. 154(b) by 132 days.

(21) Appl. No.: 13/337,745

(22) Filed: Dec. 27, 2011

(65) Prior Publication Data

US 2012/0177522 A1 Jul. 12, 2012

(30) Foreign Application Priority Data

Jan. 7, 2011 (KR) ..... 10-2011-0001617

(51) Int. Cl.

| | |
|---|---|
| ***F01C 1/02*** | (2006.01) |
| ***F01C 1/063*** | (2006.01) |
| ***F04C 2/00*** | (2006.01) |
| ***F04C 18/00*** | (2006.01) |
| ***F04C 15/00*** | (2006.01) |
| ***F04B 49/00*** | (2006.01) |
| ***F04C 18/02*** | (2006.01) |
| ***F04C 23/00*** | (2006.01) |
| ***F04C 27/00*** | (2006.01) |

(52) U.S. Cl.

CPC ..... *F04C 18/0215* (2013.01); *F04C 18/0261* (2013.01); *F04C 23/008* (2013.01); *F04C 27/005* (2013.01)

(58) Field of Classification Search

CPC . F04C 18/0215; F04C 18/0261; F04C 23/008

USPC ..... 418/55.5, 57, 180, 270; 74/310, 2; 417/279, 307, 310

See application file for complete search history.

(56) References Cited

U.S. PATENT DOCUMENTS

| | | | | |
|---|---|---|---|---|
| 5,451,146 | A * | 9/1995 | Inagaki et al. | 417/310 |
| 5,678,985 | A * | 10/1997 | Brooke et al. | 417/299 |
| 2002/0085923 | A1 * | 7/2002 | Konishi | 417/213 |
| 2004/0067144 | A1 | 4/2004 | Iida et al. | |

FOREIGN PATENT DOCUMENTS

| | | | | |
|---|---|---|---|---|
| CN | 1690431 | A | 11/2005 | |
| EP | 2 206 926 | A2 | 7/2010 | |
| JP | 60-75796 | * | 4/1985 | F04C 29/08 |
| JP | 60075796 | A * | 4/1985 | F04C 29/08 |
| JP | 10-325396 | | 12/1998 | |

(Continued)

OTHER PUBLICATIONS

Japanese Patent JP60-75796, Translated by Scheriber Translations, Inc.*

(Continued)

*Primary Examiner* — Kenneth Bomberg
*Assistant Examiner* — Deming Wan
(74) *Attorney, Agent, or Firm* — Staas & Halsey LLP

(57) ABSTRACT

A scroll compressor includes a back pressure chamber formed at the rear of a swivel scroll to support the swivel scroll, the swivel scroll swiveling while engaging with a stationary scroll to compress a refrigerant, and a back pressure adjustment device to automatically apply first middle pressure or second middle pressure lower than the first middle pressure to the back pressure chamber based on a compression ratio.

14 Claims, 5 Drawing Sheets

(56) References Cited

FOREIGN PATENT DOCUMENTS

| | | |
|---|---|---|
| JP | 2005-256809 | 9/2005 |
| JP | 2008-303858 | 12/2008 |
| KR | 10-2002-0063429 | 8/2002 |

OTHER PUBLICATIONS

European Search report dated Mar. 15, 2015 in corresponding European Application No. 111944120-0.

* cited by examiner

SCROLL COMPRESSOR HAVING A BACK PRESSURE ADJUSTMENT DEVICE

CROSS-REFERENCE TO RELATED APPLICATIONS

This application claims the priority benefit of Korean Patent Application No. 10-2011-0001617, filed on Jan. 7, 2011 in the Korean Intellectual Property Office, the disclosure of which is incorporated herein by reference.

BACKGROUND

1. Field

Embodiments of the present invention relate to a scroll compressor having a back pressure adjustment device.

2. Description of the Related Art

Generally, a scroll compressor is an apparatus to compress a refrigerant using relative motion between a stationary scroll having a spiral type wrap and a swivel scroll.

The scroll compressor has a back pressure chamber formed at the rear of the swivel scroll to support the swivel scroll and to maintain a seal between the stationary scroll and the swivel scroll. The back pressure chamber may communicate with a point of a compression chamber formed by the stationary scroll and the swivel scroll so that an appropriate magnitude of back pressure is applied to the back pressure chamber. That is, middle pressure between suction pressure and discharge pressure is applied to the back pressure chamber as back pressure.

However, at a high compression ratio, trust planes of the stationary scroll and the swivel scroll may be worn due to relatively increased back pressure. Also, at a low compression ratio, the swivel scroll may drop due to relatively decreased back pressure.

SUMMARY

Therefore, it is an aspect of the present invention to provide a scroll compressor having a back pressure adjustment device to adjust back pressure based on a ratio of discharge pressure to suction pressure.

Additional aspects of the invention will be set forth in part in the description which follows and, in part, will be obvious from the description, or may be learned by practice of the invention.

In accordance with an aspect of the present invention, a scroll compressor includes a suction chamber into which a refrigerant is introduced from outside the compressor, a compression chamber, formed by a stationary scroll and a swivel scroll, to compress the introduced refrigerant, a discharge chamber into which the compressed refrigerant is discharged, a first middle pressure region communicating with the compression chamber at a first location, a second middle pressure region communicating with the compression chamber at a second location different from the first location, a back pressure chamber formed at the rear of the swivel scroll to apply pressure to the swivel scroll, and a back pressure adjustment device to control the back pressure chamber to communicate with either the first middle pressure region or the second middle pressure region based on a compression ratio.

The back pressure adjustment device may include a cylinder having a first path, through which the first middle pressure region communicates with the back pressure chamber, and a second path, through which the second middle pressure region communicates with the back pressure chamber, and a piston disposed in the cylinder so that the piston reciprocates to selectively open and close the first path and the second path.

The upper part of the cylinder may communicate with the discharge chamber so that discharge pressure is applied to the upper end of the piston.

The lower part of the cylinder may communicate with the suction chamber so that suction pressure is applied to the lower end of the piston.

The upper inner circumference of the cylinder may have a diameter less than that of the lower inner circumference of the cylinder.

The cylinder may be provided at the lower end thereof with a seat having a diameter less than that of the lower end of the piston.

The piston may include a first opening and closing part to open and close the first path and a second opening and closing part to open and close the second path.

The upper end of the piston may have a diameter less than that of the lower end of the piston.

The first middle pressure region and the second middle pressure region may be defined in the stationary scroll.

The first middle pressure region may be closer to the discharge chamber than the second middle pressure region.

In accordance with another aspect of the present invention, a scroll compressor includes a back pressure chamber formed at the rear of a swivel scroll to support the swivel scroll, the swivel scroll swiveling while engaging with a stationary scroll to compress a refrigerant, and a back pressure adjustment device to automatically apply a first middle pressure or a second middle pressure lower than the first middle pressure to the back pressure chamber based on a compression ratio.

The back pressure adjustment device may include a cylinder having a first path to apply the first middle pressure to the back pressure chamber and a second path to apply the second middle pressure to the back pressure chamber.

The back pressure adjustment device may further include a piston disposed in the cylinder so that the piston reciprocates to selectively open and close the first path and the second path.

In accordance with another aspect of the present invention, a method of adjusting back pressure in a swivel scroll in a scroll compressor comprises introducing a refrigerant into a suction chamber, compressing the introduced refrigerant in a compression chamber formed by a stationary scroll and a swivel scroll, discharging the compressed refrigerant into a discharge chamber, forming a back pressure chamber to apply back pressure to the swivel scroll, and adjusting the back pressure in the back pressure chamber by communicating the back pressure chamber with different pressures from different locations in the compression chamber.

BRIEF DESCRIPTION OF THE DRAWINGS

These and/or other aspects of the invention will become apparent and more readily appreciated from the following description of the embodiments, taken in conjunction with the accompanying drawings of which.

DETAILED DESCRIPTION

Figure 1:
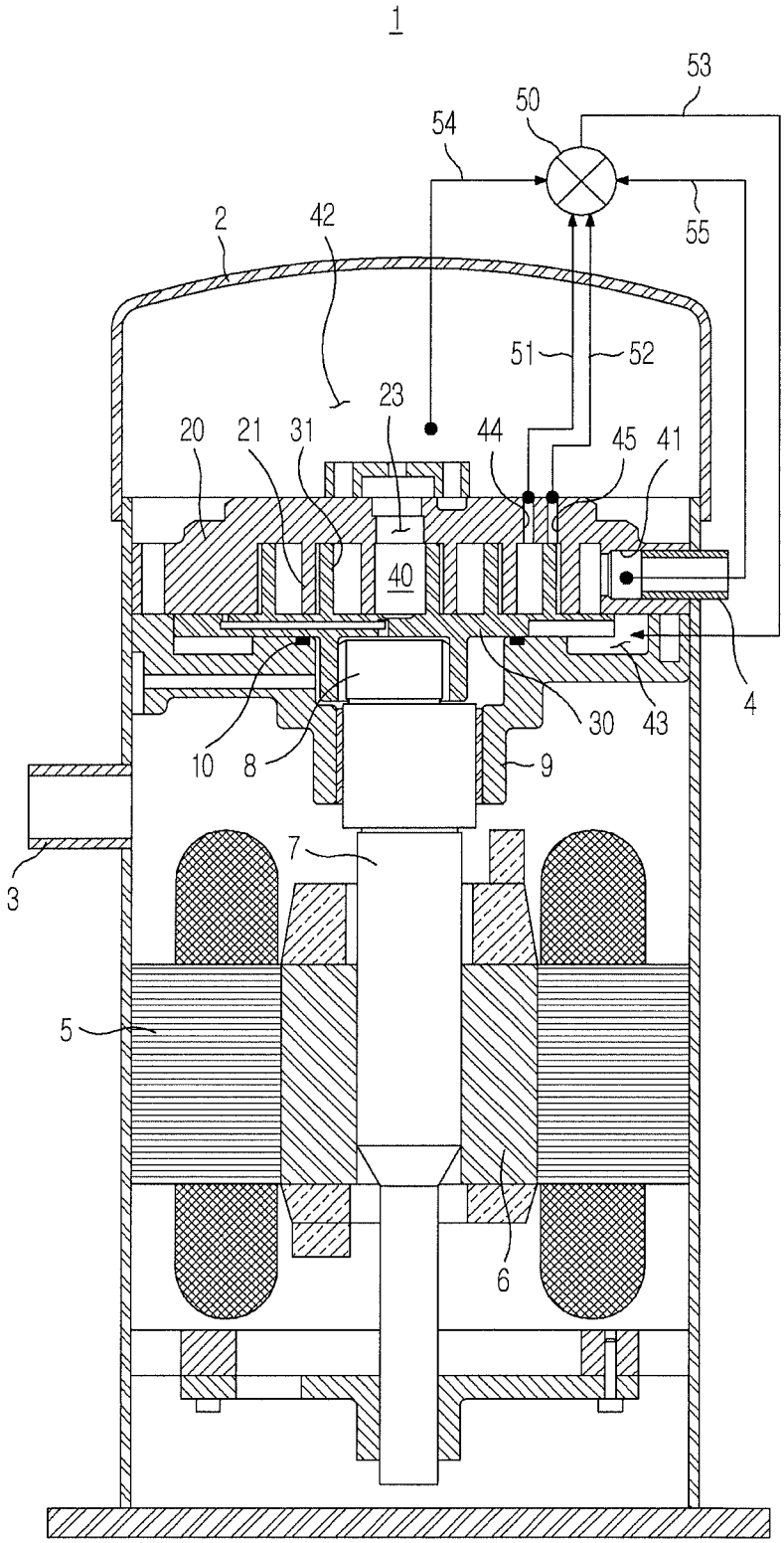
FIG. 1 is a sectional view illustrating a scroll compressor according to an embodiment of the present invention.

Reference will now be made in detail to the embodiments of the present invention, examples of which are illustrated in the accompanying drawings, wherein like reference numerals refer to like elements throughout.

FIG. 1 is a sectional view illustrating a scroll compressor according to an embodiment of the present invention.

As shown in FIG. 1, a scroll compressor 1 includes a housing 2, a drive unit, and a compression unit.

The housing 2 is provided at one side thereof with an outlet port 3, through which a compressed refrigerant is discharged to the outside. The housing 2 is also provided at one side thereof with an inlet port 4, through which a refrigerant is introduced.

The drive unit includes a stator 5 forcibly fitted in the lower side of the housing 2 and a rotor 6 rotatably disposed at the middle of the stator 5. An eccentric part 8, which eccentrically rotates, is provided at the upper end of a drive shaft 7.

The compression unit includes a frame 9 fitted on the drive shaft 7 and fixed to the upper end of the inner circumference of the housing 2, a swivel scroll 30 driven by the drive shaft 7, the swivel scroll 30 having a spiral type swivel scroll wrap 31 formed at the top thereof, and a stationary scroll 20 having a stationary scroll wrap 21 formed at the bottom thereof, the stationary scroll wrap 21 engaging with the swivel scroll wrap 31.

A sealing member 10, formed in the shape of a circular strip, is mounted in a circular groove formed at a thrust plane of a frame 9 to form a back pressure chamber 43 at the rear of the swivel scroll 30. The stationary scroll 20 is fixed to the upper side of the frame 9, and the swivel scroll 30 swivels at the lower side of the stationary scroll 20 so that the stationary scroll wrap 21 engages with the swivel scroll wrap 31.

A refrigerant, introduced into a suction chamber 41, is moved to a compression chamber 40 by the stationary scroll 20 and the swivel scroll 30 and is compressed by swiveling motion of the swivel scroll 30. The compressed high-pressure refrigerant is discharged to a discharge chamber 42 through a discharge port 23 of the stationary scroll 20.

A first middle pressure region 44 communicating with a point of the compression chamber 40 and a second middle pressure region 45 communicating with another point of the compression chamber 40 are defined in the stationary scroll 20.

The first middle pressure region 44 communicates with the inner part of the compression chamber 40 so that higher pressure is formed in the first middle pressure region 44 than in the second middle pressure region 45. That is, the first middle pressure region 44 is closer to the discharge chamber 42 than the second middle pressure region 45.

Meanwhile, the scroll compressor further includes a back pressure adjustment device, or valve, 50. The back pressure adjustment device 50 communicates with the first middle pressure region 44 through a first middle pressure passage 51. Also, the back pressure adjustment device 50 communicates with the second middle pressure region 45 through a second middle pressure passage 52.

Also, the back pressure adjustment device 50 communicates with the back pressure chamber 43 through a back pressure passage 53. In addition, the back pressure adjustment device 50 communicates with the suction chamber 41 through a suction pressure passage 55. Also, the back pressure adjustment device 50 communicates with the discharge chamber 42 through a discharge pressure passage 54.

Figure 2:
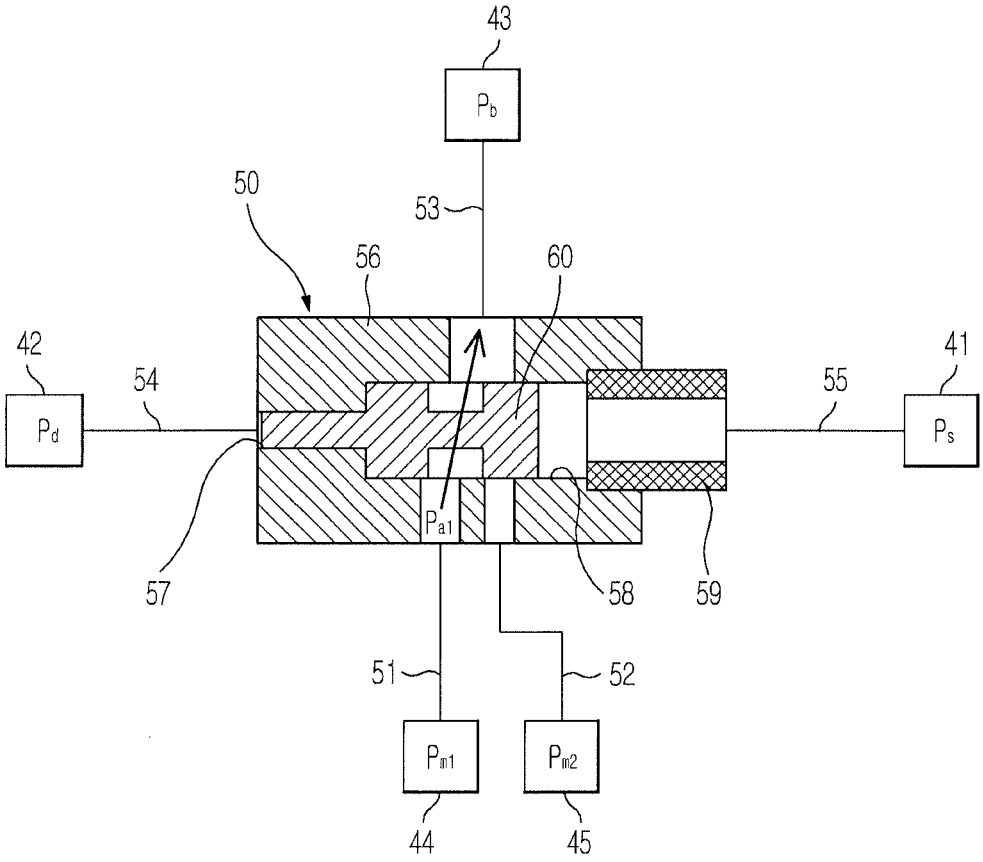
FIG. 2 is a sectional view of a back pressure adjustment device of the scroll compressor of FIG. 1 illustrating an open state of a first path.
Figure 3:
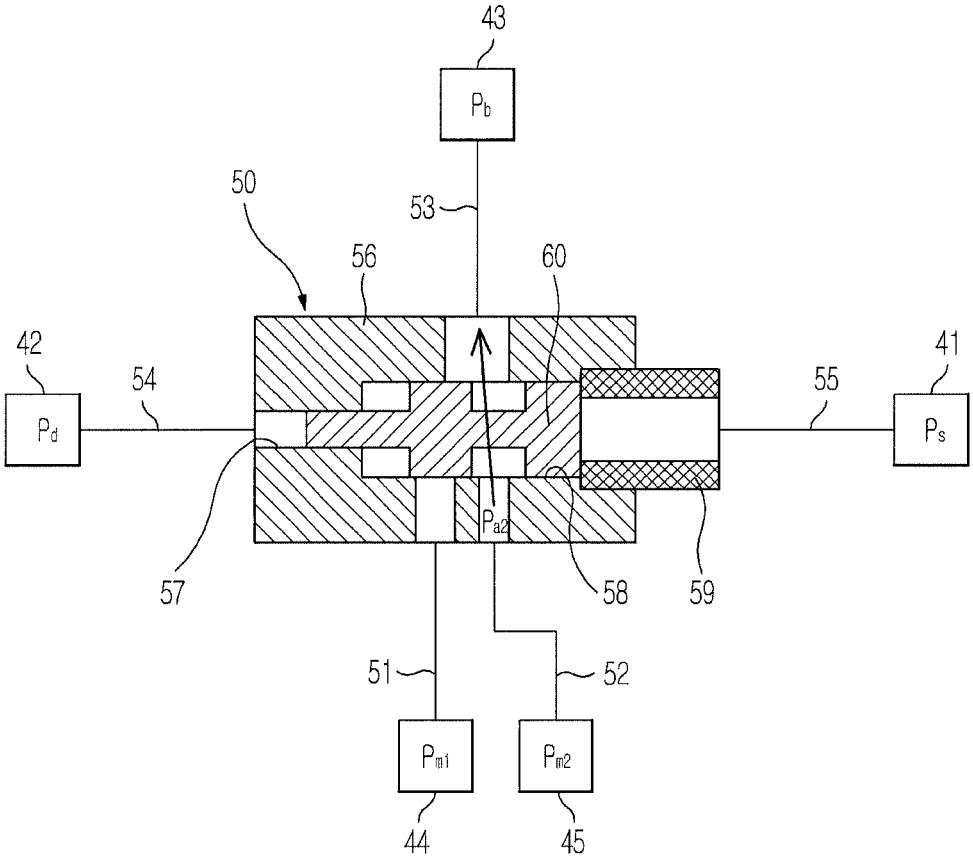
FIG. 3 is a sectional view of the back pressure adjustment device of the scroll compressor of FIG. 1 illustrating an open state of a second path.
Figure 4:
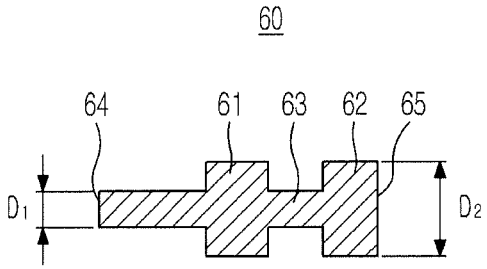
FIG. 4 is a sectional view illustrating a piston of the scroll compressor of FIG. 1.
Figure 5:
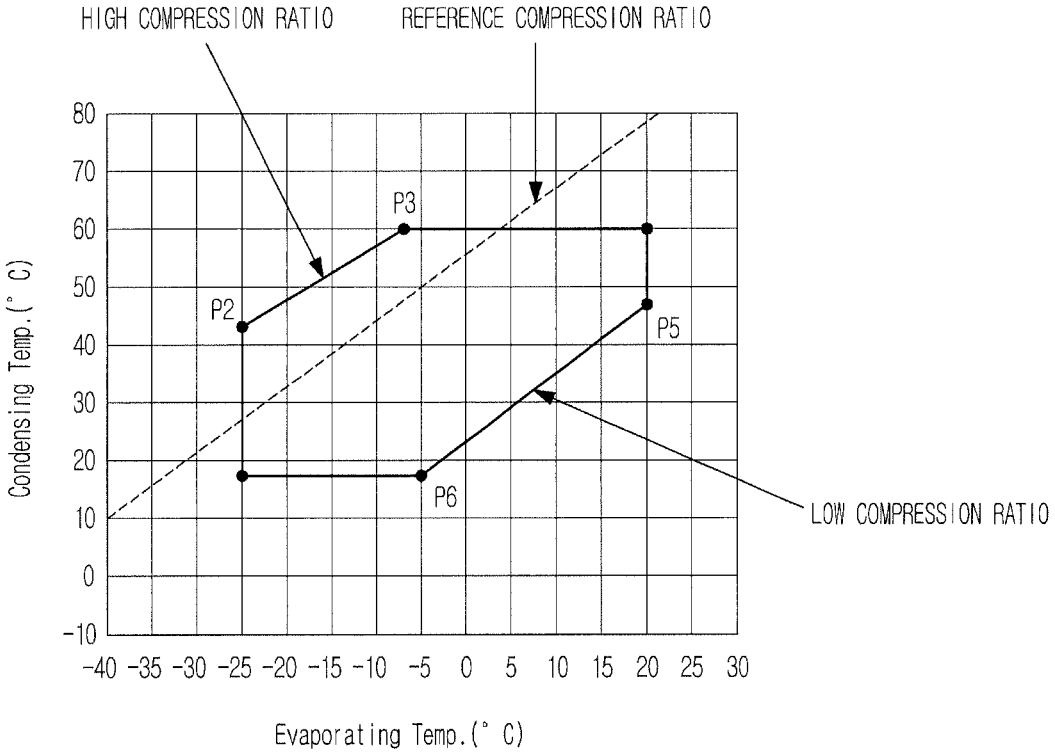
FIG. 5 is an explanatory view of a reference compression ratio for mode conversion.

FIG. 2 is a sectional view of the back pressure adjustment device of the scroll compressor of FIG. 1 illustrating an open state of a first path, and FIG. 3 is a sectional view of the back pressure adjustment device of the scroll compressor of FIG. 1 illustrating an open state of a second path. FIG. 4 is a sectional view illustrating a piston of the scroll compressor of FIG. 1. FIG. 5 is an explanatory view of a reference compression ratio for mode conversion.

As shown in FIGS. 2 and 3, the back pressure adjustment device 50 includes a cylinder 56 and a piston 60 disposed in the cylinder 56. The piston 60 is disposed in the cylinder 56 so that the piston 60 vertically reciprocates.

The upper part of the cylinder 56 communicates with the discharge chamber 42 through the discharge pressure passage 54 so that discharge pressure Pd is applied to the upper end 64 of the piston 60. The lower part of the cylinder 56 communicates with the suction chamber 41 through the suction pressure passage 55 so that suction pressure Ps is applied to the lower end 65 of the piston 60.

In this structure, the piston 60 may move upward or downward based on a compression ratio of discharge pressure Pd to suction pressure Ps.

On the assumption that the diameter of the upper end 64 of the piston 60 is D1 and the diameter of the lower end 65 of the piston 60 is D2, the piston 60 moves upward when $Pd \times D1^2 < Ps \times D2^2$ as shown in FIG. 2 and downward when $Pd \times D1^2 > Ps \times D2^2$ as shown in FIG. 3.

Consequently, the diameter D1 of the upper end 64 of the piston 60 and the diameter D2 of the lower end 65 of the piston 60 may be appropriately designed to decide a reference compression ratio at which the piston 60 moves upward and downward.

The reference compression ratio may be set to a predetermined ratio between a high compression ratio and a low compression ratio as shown in FIG. 5. In FIG. 5, the horizontal axis indicates evaporating temperature and the vertical axis indicates condensing temperature. The lower compression ratio is approximately distributed between point P5 and point P6, and the high compression ratio is approximately distributed between point P2 and point P3.

Since the discharge pressure Pd is higher than the suction pressure Ps, the diameter D1 of the upper end 64 of the piston 60 is designed to be less than the diameter D2 of the lower end 65 of the piston 60.

Meanwhile, as shown in FIG. 2, the cylinder 56 has a first path Pa1, through which the first middle pressure passage 51 communicates with the back pressure passage 53 and thus the first middle pressure region 44 communicates with the back pressure chamber 43.

Also, as shown in FIG. 3, the cylinder 56 has a second path Pa2, through which the second middle pressure passage 52 communicates with the back pressure passage 53 and thus the second middle pressure region 45 communicates with the back pressure chamber 43.

When the first path Pa1 is opened, therefore, first middle pressure Pm1 is applied to the back pressure chamber 43. When the first path Pa2 is opened, therefore, second middle pressure Pm2 is applied to the back pressure chamber 43.

The first path Pa1 and the second path Pa2 are selectively opened and closed by the piston 60. The piston 60 includes a first opening and closing part 61 to open and close the first path Pa1 and a second opening and closing part 62 to open and close the second path Pa2. The first opening and closing part 61 and the second opening and closing part 62 are connected to each other via a connection part 63.

The first opening and closing part 61 and the second opening and closing part 62 are in tight contact with the inner circumference of the cylinder 56. The connection part 63 may have a diameter less than that of the inner circumference of the cylinder 56 to form the first path Pa1 or the second path Pa2.

Also, the cylinder 56 is formed so that the upper inner circumference 57 of the cylinder 56 has a diameter less than that of the lower inner circumference 58 of the cylinder 56 so as to correspond to the shape of the piston 60. A seat 59 having a diameter less than that of the lower end 65 of the piston to prevent separation of the piston 60 may be formed at the lower end of the cylinder 56.

The back pressure adjustment device 50 with the above-stated construction may automatically apply the first middle pressure Pm1 or the second middle pressure Pm2, which is less than the first middle pressure Pm1, to the back pressure chamber 43 according to a compression ratio.

That is, when the compression ratio (Pd/Ps) is high, the second middle pressure Pm2, which is relatively low, is applied to the back pressure chamber 43, and, when the compression ratio (Pd/Ps) is low, the first middle pressure Pm1, which is relatively high, is applied to the back pressure chamber 43.

Hereinafter, the operation of the scroll compressor 1 will be described briefly with reference to FIGS. 1 to 5.

When the operation of the scroll compressor 1 is initiated, the drive shaft 7 fixed to the rotor 6 is rotated by electromotive force generated by the stator 5 with the result that the swivel scroll 30 fitted in the eccentric part 9 provided at the upper end of the drive shaft 7 swivels in a state in which the swivel scroll 30 is engaged with the stationary scroll 20.

A refrigerant, introduced through the inlet port 4, moves to the compression chamber 40 formed by the swivel scroll 30 and the stationary scroll 20 via the suction chamber 41, and is compressed by swiveling motion of the swivel scroll 30.

The compressed high-pressure refrigerant is discharged to the outside through the outlet port 3 via the discharge chamber 42.

At this time, when the scroll compressor 1 is operated at a low compression ratio, lower than a predetermined reference compression ratio, the piston 60 of the back pressure adjustment device 50 moves upward to open the first path Pa1 and close the second path Pa2, as shown in FIG. 2. First middle pressure Pm1, which is relatively high, is applied to the back pressure chamber 43 through the open first path Pa1.

On the other hand, when the scroll compressor 1 is operated at a compression ratio higher than the predetermined reference compression ratio, the piston 60 of the back pressure adjustment device 50 moves downward to close the first path Pa1 and open the second path Pa2, as shown in FIG. 3. Second middle pressure Pm2, which is relatively low, is applied to the back pressure chamber 43 through the open second path Pa2.

As is apparent from the above description, the magnitude of back pressure is adjusted at the high compression ratio and the low compression ratio. Consequently, the magnitude of back pressure is appropriately maintained although the compression ratio is changed, and therefore, the operating range of the scroll compressor is widened.

Although a few embodiments of the present invention have been shown and described, it would be appreciated by those skilled in the art that changes may be made in these embodiments without departing from the principles and spirit of the invention, the scope of which is defined in the claims and their equivalents.

What is claimed is:

1. A method of adjusting back pressure in a swivel scroll in a scroll compressor, the method comprising:

introducing a refrigerant into a suction chamber;

compressing the introduced refrigerant in a compression chamber formed by a stationary scroll and a swivel scroll;

discharging the compressed refrigerant into a discharge chamber;

creating a back pressure in a back pressure chamber to apply the back pressure to the swivel scroll; and adjusting the back pressure in the back pressure chamber by selectively communicating the back pressure chamber with a first pressure from a first location in the compression chamber and with a different second pressure that is lower than the first pressure from a different second location in the compression chamber.

2. A scroll compressor comprising:

a swivel scroll;

a stationary scroll;

a back pressure chamber formed at a rear of the swivel scroll to support the swivel scroll, the swivel scroll swiveling while engaging with the stationary scroll to compress a refrigerant; and a back pressure adjustment valve capable of automatically applying a first middle pressure to the back pressure chamber and applying a second middle pressure lower than the first middle pressure to the back pressure chamber, wherein an automatically applying of one of the first middle pressure and the second middle pressure based on a compression ratio.

3. The scroll compressor according to claim 2, wherein the back pressure adjustment valve comprises a cylinder having a first path to apply the first middle pressure to the back pressure chamber and a second path to apply the second middle pressure to the back pressure chamber.

4. The scroll compressor according to claim 3, wherein the back pressure adjustment valve further comprises a piston disposed in the cylinder so that the piston reciprocates to selectively open and close the first path and the second path.

5. A scroll compressor comprising:

a suction chamber into which a refrigerant is introduced from outside the compressor;

a compression chamber, formed by a stationary scroll and a swivel scroll, to compress the introduced refrigerant;

a discharge chamber into which the compressed refrigerant is discharged;

a first middle pressure region communicating with the compression chamber at a first location;

a second middle pressure region communicating with the compression chamber at a second location different from the first location;

a back pressure chamber formed at the rear of the swivel scroll to apply pressure to the swivel scroll; and a back pressure adjustment valve capable of selectively communicating a first communicating of the back pressure chamber with the first middle pressure region and a second communicating of the back pressure chamber with the second middle pressure region, a selective communicating of the first communicating and the second communicating based on a compression ratio, and wherein the first middle pressure region is closer to the discharge chamber than the second middle pressure region.

6. The scroll compressor according to claim 5, wherein the back pressure adjustment valve comprises:

a cylinder having a first path, through which the first middle pressure region communicates with the back pressure chamber, and a second path, through which the second middle pressure region communicates with the back pressure chamber; and a piston disposed in the cylinder so that the piston reciprocates to selectively open and close the first path and the second path.

7. The scroll compressor according to claim 6, wherein the upper part of the cylinder communicates with the discharge chamber so that discharge pressure is applied to the upper end of the piston.

8. The scroll compressor according to claim 6, wherein the lower part of the cylinder communicates with the suction chamber so that suction pressure is applied to the lower end of the piston.

9. The scroll compressor according to claim 6, wherein the upper inner circumference of the cylinder has a diameter less than that of the lower inner circumference of the cylinder.

10. The scroll compressor according to claim 6, wherein the cylinder is provided at the lower end thereof with a seat having a diameter less than that of the lower end of the piston.

11. The scroll compressor according to claim 6, wherein the piston comprises a first opening and closing part to open and close the first path and a second opening and closing part to open and close the second path.

12. The scroll compressor according to claim 6, wherein the upper end of the piston has a diameter less than that of the lower end of the piston.

13. The scroll compressor according to claim 5, wherein the first middle pressure region and the second middle pressure region are defined in the stationary scroll.

14. The scroll compressor according to claim 5, wherein the compression ratio is a ratio of pressure in the discharge chamber to pressure in the suction chamber.

* * * * *